US007040527B2

(12) United States Patent
Kasuya

(10) Patent No.: US 7,040,527 B2
(45) Date of Patent: May 9, 2006

(54) FIBER DRUM, CYLINDRICAL BODY THEREOF, AND METHOD OF FABRICATING THE CYLINDRICAL BODY

(75) Inventor: Motoharu Kasuya, Wakayama (JP)

(73) Assignee: Taiyo Sealpack Co., Ltd., Wakayama (JP)

( * ) Notice: Subject to any disclaimer, the term of this patent is extended or adjusted under 35 U.S.C. 154(b) by 328 days.

(21) Appl. No.: 09/761,189

(22) Filed: Jan. 18, 2001

(65) Prior Publication Data

US 2002/0092900 A1 Jul. 18, 2002

(51) Int. Cl.
*B65D 9/10* (2006.01)
*B65D 3/30* (2006.01)

(52) U.S. Cl. ..... 229/5.5; 229/5.6

(58) Field of Classification Search ..... 229/5.5, 229/4.5, 5.6, 5.8; 220/620; 53/409; 710/8
See application file for complete search history.

(56) References Cited

U.S. PATENT DOCUMENTS

| | | | | | |
|---|---|---|---|---|---|
| 1,031,615 | A | * | 7/1912 | Beadle | 229/5.5 X |
| 1,096,880 | A | * | 5/1914 | Wright | 229/5.6 X |
| 1,256,933 | A | | 2/1918 | Schriner | |
| 1,301,840 | A | * | 4/1919 | Hawkins | 229/5.5 X |
| 1,462,443 | A | * | 7/1923 | Brooks | 229/5.5 X |
| 1,685,370 | A | * | 9/1928 | Moore | 229/5.6 X |
| 1,700,742 | A | * | 2/1929 | Moore | 229/5.6 X |
| 1,796,075 | A | * | 3/1931 | Bilxt | 229/5.6 X |
| 1,912,884 | A | * | 6/1933 | Bodor | 229/5.6 X |
| 2,120,900 | A | * | 6/1938 | Moore | 229/5.5 X |
| 2,141,556 | A | * | 12/1938 | Reifsnyder | 413/5 |
| 2,406,758 | A | * | 9/1946 | Gazette | 229/5.5 X |
| 2,623,681 | A | * | 12/1952 | Wilcox | 229/4.5 |
| 2,633,095 | A | * | 3/1953 | Magill et al. | 413/5 |
| 2,641,827 | A | * | 6/1953 | Carpenter | 229/5.5 X |
| 3,381,594 | A | | 5/1968 | Ellerbrock et al. | |
| 4,190,187 | A | | 2/1980 | Nelms | |
| 4,368,841 | A | | 1/1983 | Eddy | |
| 4,375,969 | A | | 3/1983 | Woerz | |
| 4,538,758 | A | | 9/1985 | Griffith | |
| 4,557,414 | A | | 12/1985 | Ford et al. | |
| 4,890,786 | A | | 1/1990 | Oberhofer et al. | |
| 6,502,741 | B1 | * | 1/2003 | Kasuya | 229/5.5 |

FOREIGN PATENT DOCUMENTS

| | | |
|---|---|---|
| EP | 0458662 | 11/1991 |
| FR | 2766459 | 1/1999 |
| GB | 2266490 | 11/1993 |
| GB | 2314827 | 1/1998 |

* cited by examiner

*Primary Examiner*—Tri Mai
(74) *Attorney, Agent, or Firm*—Wenderoth, Lind & Ponack, L.L.P.

(57) ABSTRACT

A cylindrical body of a fiber drum comprises a roll of paper material having two open ends, and a curled portion formed by inwardly curling the edge of at least one of the two open ends. A method of fabricating the fiber drum comprises the steps of winding a length of paper sheet in layers, between which an adhesive is applied, to form a roll of the paper sheet having two open ends, and inwardly curling the edge of at least one of the two open ends of the roll to form a curled portion before the adhesive is cured between the layers.

18 Claims, 10 Drawing Sheets

FIBER DRUM, CYLINDRICAL BODY THEREOF, AND METHOD OF FABRICATING THE CYLINDRICAL BODY

BACKGROUND OF THE INVENTION

1. Field of the Invention

The present invention relates to a fiber drum made mainly of a paper material, a cylindrical body of the paper material constituting the fiber drum, and a method of fabricating the cylindrical body.

2. Prior Art of the Invention

One of such conventional cylindrical bodies of a fiber drum is illustrated in FIG. 13. The cylindrical body consists mainly of a roll B of a paper sheet S having a bottom at one end. The roll B has an opening C thereof at the other end and an edge thereat is inwardly curled together with a metal ring E thus forming an inwardly curled rim F.

The metal ring E has an inward rib G at an intermediate portion thereof projected substantially 10 mm inwardly of the roll B.

As the cylindrical body A has the paper sheet S and the metal ring E curled together, its curled rim F will particularly require more labor and time to be disassembled during a recycling process. Also, the rim F has to be further separated into the metal ring E and the paper sheet S with extra labor. Once an amount of powder or grains is directly loaded into the fiber drum with no use of any inner bag, a portion of the powder or grains may be trapped by the inward rib G and the inwardly curled rim F of the cylindrical body A, and thus be failed to be removed from the drum.

We, the inventors, have proposed a modified fiber drum disclosed in Japanese Patent Laid-open Publication 2000-185724 as shown in FIG. 14. A cylindrical body A2 of the fiber drum shown in FIG. 14 comprises a roll B2 having a cylindrical shape and made of simply a paper material with an adhesive. The roll B2 in its vertical position has outwardly curled portions I and J provided on both, upper and lower, ends thereof at openings. The cylindrical body A2 is accompanied with a cover plate K and a bottom plate L both made of a paper material, hence constituting a fiber drum D. The cover plate K consists mainly of a top portion M having a disk shape and a rim portion N extending perpendicularly from the top portion M for being detachably joined to the upper curled portion I of the cylindrical body A2. The bottom plate L consists mainly of a bottom portion O having a disk shape and a rim portion P extending perpendicularly from the bottom portion O and bonded by an adhesive to the lower curled portion J. The drum is filled with desired objects and then sealed at the joint between the rim portion N of the cover plate K and the roll B2 with a length of sealing tape (not shown). Accordingly, the fiber drum D using no metal material can easily be disassembled. Also, as the cylindrical body A2 has no projection on its inner side, contents such as powder can be completely removed with no residue remaining in the drum.

However, the body B2 of the fiber drum D shown in FIG. 14 has its inner side turned over the outer side for forming the curled portions I and J. As the material of the inner side is pulled radially of the opening at each end, the curled portion I or J may have a flaw. The flaw will then result in the generation of paper dust. For compensation, the curled portions I and J after formed are often coated at their surfaces with a resin material or the like. This will result in extra labor and cost.

SUMMARY OF THE INVENTION

The present invention has been developed in view of the foregoing aspects and its object is to provide a fiber drum, a cylindrical body thereof, and a method of fabricating the cylindrical body where the physical strength at each opening end of the cylindrical body is substantially high, contents can be loaded and unloaded to and from the drum without difficulty, separation of a paper material from other materials is not needed, and injury during forming or processing the drum is minimized.

For achievement of the object, a cylindrical body of a fiber drum according to the present invention comprises a roll of a paper material having at one open end and/or the other open end a curled portion formed by inwardly curling an edge of the one open end and/or the other open end. As the curled portion is made of the same material as that of the roll, physical strength will be increased at the one open end or the other open end. As no metal material is used, separation of the paper material from metals is unnecessary during disposal of the drum.

A method of fabricating a cylindrical body of a fiber drum according to the present invention is provided, which method comprises the steps of winding a length of paper sheet into layers, between which an adhesive is applied, to form a roll of the paper sheet, and inwardly curling an edge of one open end and/or the other open end of the roll to form a curled portion before the adhesive is cured between the layers. As the step of forming the curled portion takes a short amount of time, the fabrication of the cylindrical body will be improved with regard to efficiency, hence permitting mass production.

Alternatively, the method of fabricating a cylindrical body of a fiber drum is modified in which the curled portion formed by inwardly curling the edge of one open end and/or the other open end of the roll is then pressed. Because the curled portion is inwardly curled, the pressing process will not develop flaws in the curled portion as compared with an outwardly curled portion of the prior art.

A fiber drum according to the present invention is provided comprising a cylindrical body having a couple of curled portions provided at one open end and the other open end of a roll of a paper material by inwardly curling edges of the one open end and the other open end, a cover plate made of a paper material detachably joined to the curled portion at the one open end to close an opening of the roll of the cylindrical body, and a bottom plate made of a paper material fixedly joined to the curled portion at the other open end to close the other opening of the roll of the cylindrical body. Because the cylindrical body, the cover plate, and the bottom plate all are made of paper material, separation of the paper material from other metal materials will be unnecessary during the disposal of the fiber drum.

Another fiber drum according to the present invention is provided comprising a cylindrical body having a curled portion provided at one open end of a roll of a paper material by inwardly curling an edge of the one open end, a cover plate made of a paper material detachably joined to the one open end to close one opening of the roll of the cylindrical body, and a bottom plate made of a paper material fixedly joined to the other open end to close the other opening of the roll of the cylindrical body, wherein the edge of the other open end of the roll is inwardly curled together with a circumferential edge of the bottom plate to fixedly join the other open end of the roll to the bottom plate. The cylindrical body and the bottom plate are inwardly curled at once, hence eliminating a sequence of the steps of forming the cylindrical body and the bottom plate separately and then bonding them together. As the overall number of steps of the method is decreased, a reduction in cost will be guaranteed. Also, the inner side of the cylindrical body has no projection adjacent to the bottom plate, hence allowing contents of the drum to be readily discharged without being trapped as compared with the conventional body having an inner rib, and allowing the drum to be free of any residue.

DETAILED DESCRIPTION OF THE PREFERRED EMBODIMENTS

A first embodiment of the present invention will be described in more detail ref erring to the relevant drawings.

Figure 1:
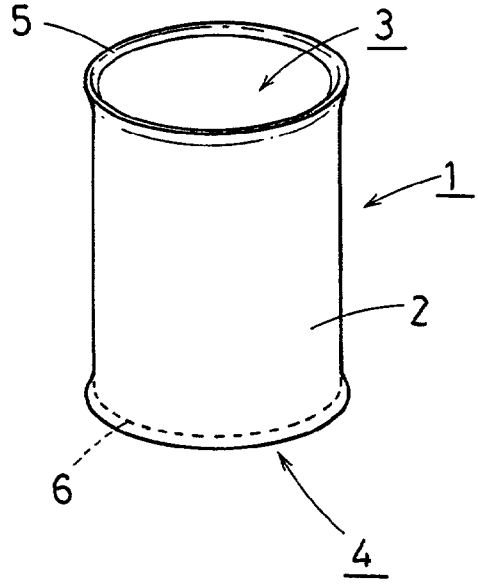
FIG. 1 is an external view of the cylindrical body of a fiber drum according to first embodiment of the present invention.
Figure 2:
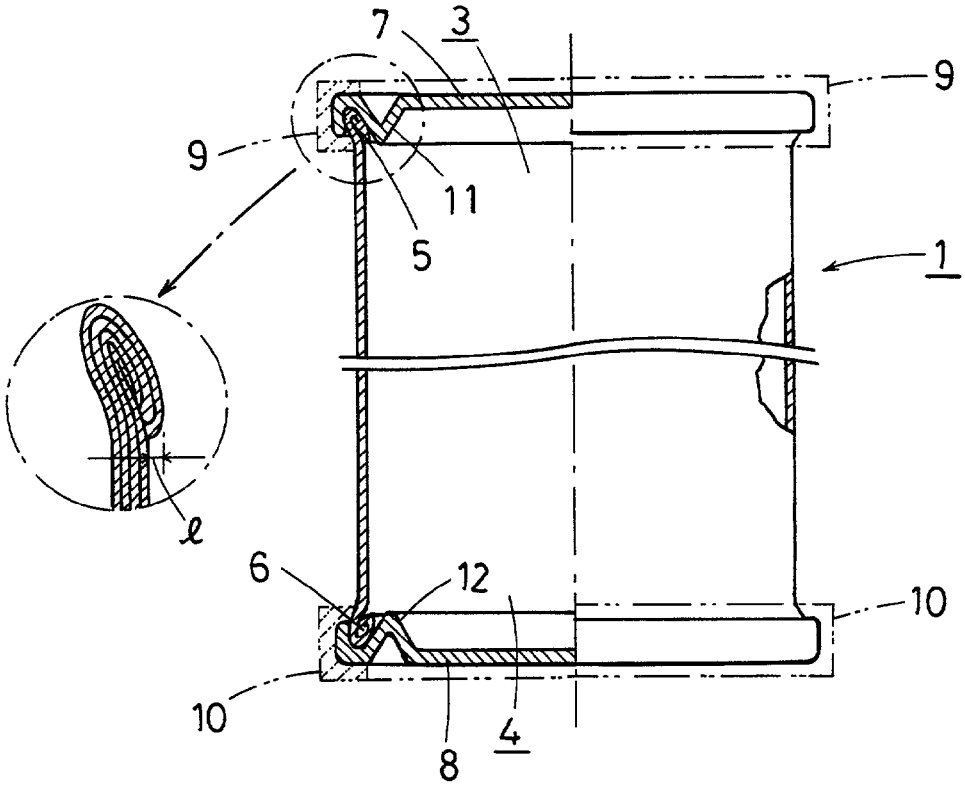
FIG. 2 is a partially cross sectional front view of the cylindrical body.

FIG. 1 is an external view showing a cylindrical body of a fiber drum of the embodiment. FIG. 2 is a partially cross sectional front view of the cylindrical body.

As shown, the cylindrical body 1 of the fiber drum consists mainly of a roll 2 of a paper material with an adhesive. The roll 2 may be made of a plurality of paper sheets or a single sheet of paper which is rolled as will be explained later.

The roll 2 in its vertical position has an opening 3 thereof provided at the upper end and an opening 4 at the other end. The roll 2 has an upper edge curled inwardly at the one opening 3 forming a curled portion 5 which is oval in cross section and annular in plan view as continuous along the circumference. The curled portion 5 is tilted outwardly and radially of the roll 2. The curled portion 5 is defined by an end portion of the roll 2 which is curled upon itself so tightly pressed such that a first portion of an inner surface of the roll contacts a second portion of the roll so as to eliminate a hollow space between these portions, and a thickness of the curled portion is substantially 1 mm greater than the thickness of the roll 2. The lower edge at the other opening 4 of the roll 2 also is inwardly curled to form a curled portion 6 which is identical in size to that of the curled portion 5. Each of the curled portions 5 and 6 is defined by paper and adhesive, and is free of any interior support ring.

Figure 3:
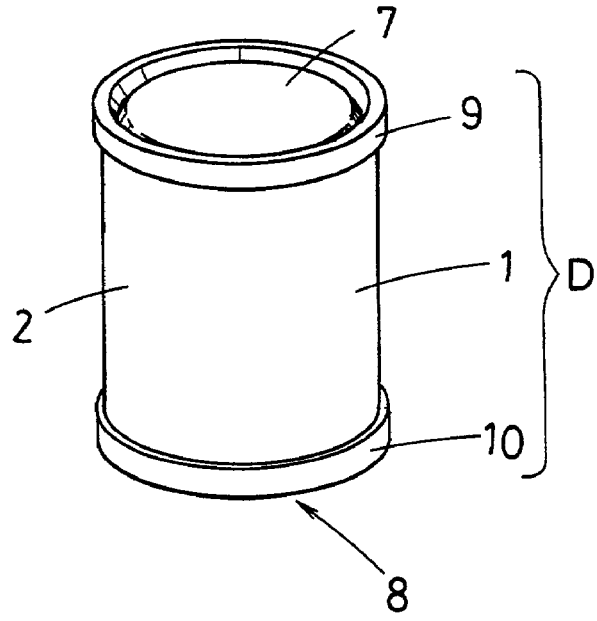
FIG. 3 is an external view of the fiber drum according to the first embodiment of the present invention.

The cylindrical body 1 having the above arrangement is accompanied, as shown in FIGS. 2 and 3, with a cover plate 7 and a bottom plate 8 both made of a paper material, thus constituting a fiber drum D. The cover plate 7 and the bottom plate 8 are of a disk shape and reinforced at outer edge with reinforcement ribs 11 and 12, respectively, which are annular in plan view. The cover plate 7 and the bottom plate 8 are detachably mounted to the corresponding curled portions 5 and 6 at the one opening 3 and the other opening 4, respectively. The joints between the cover plate 7 and the curled portion 5 and between the bottom plate 8 and the curled portion 6 are covered with a couple of tightening bands 9 and 10, respectively, to seal the fiber drum D.

The fiber drum D comprises the cylindrical body 1, the cover plate 7, and the bottom plate 8 made of the paper material, employing no metal. Accordingly, when out of use and discarded, the fiber drum D requires no traditional separation into paper and metal. As the curled portions 5 and 6 are inwardly curled, they develop no tension towards the radial direction and will be prevented from generation of flaws as compared with outwardly curled portions. The curled portions 5 and 6 are tilted radially and outwardly of the cylindrical body 2 and can thus be joined to the cover plate 7 and the bottom plate 8 more closely while being covered with their respective tightening bands 9 and 10. This eliminates the need of specific seals or packings. While the curled portions 5 and 6 of the cylindrical body 1 according to the present invention are rigid enough without being pressed down, their pressed-down structure having no hollow space will contribute to increased physical strength of the cylindrical body 1. Moreover, the difference between the curled portions 5 and 6 and the other portion of the cylindrical body 1 (i.e. dimension "l" as shown in FIG. 2) is as small as 1 mm. Stated otherwise, a radial distance between a line that is tangent to an inner circumferential surface of the curled portion 5 or 6 and a line defined by an inner circumferential surface of the cylindrical body 1 is represented by dimension "l" and is no greater than 1 mm. Accordingly, because of this small distance the inner side of the cylindrical body 1 is less undulated such that any content such as powder can successfully be removed from the fiber drum D without being trapped.

Figure 11:
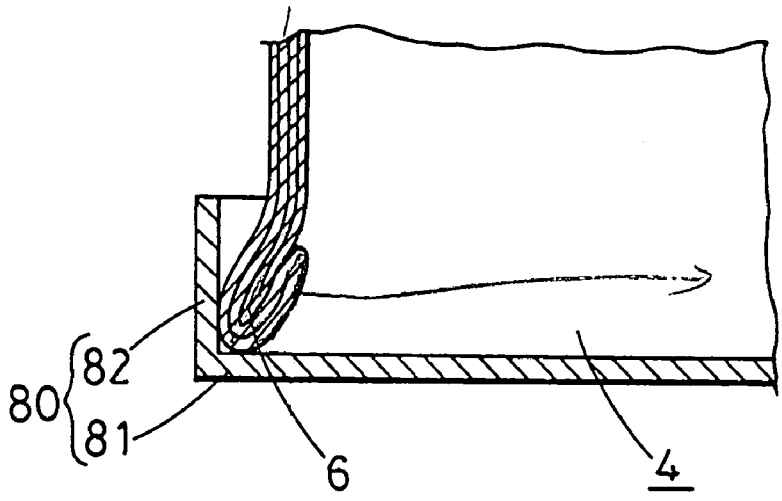
FIG. 11 is a cross sectional front view showing partially a modification of the bottom of the fiber drum.

The present invention is not limited to the embodiment with the tightening bands provided about the one opening 3 and the other opening 4 for sealing the drum. For closing the other opening 4 of the cylindrical body 1, the curled portion 6 may be bonded by an adhesive to a bottom member 80 which comprises a bottom portion 81 and a flange portion 82 extending from an edge of the bottom portion 81 as shown in FIG. 11. Similarly, the one opening 3 of the cylindrical body 1 may be closed with a cover member (not shown), which comprises a cover portion and a flange portion extending from an edge of the cover portion, bonded to the curled portion 5 by an adhesive.

A method of fabricating the cylindrical body 1 will now be described.

Figure 4:
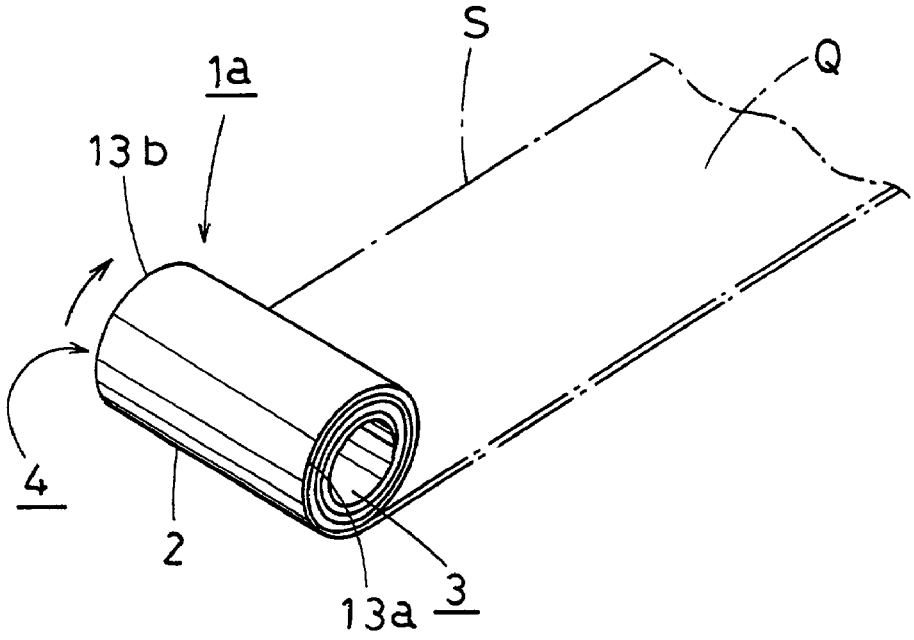
FIG. 4 is an explanatory view illustrating a step of fabricating a green form of the cylindrical body.

The method starts with a step of forming a green cylindrical body 1*a* as shown in FIG. 4. More specifically, a length of paper sheet S coated at its upper side with an adhesive Q before curing is wound in seven to eight layers on a mandrel of a drum forming machine (not shown) to form a roll 2 of the green cylindrical body 1*a*. The adhesive Q may be any commercially available hydrophilic adhesive composed mainly of e.g. poly-vinyl acetate emulsion or poly-vinyl alcohol.

Figure 5:
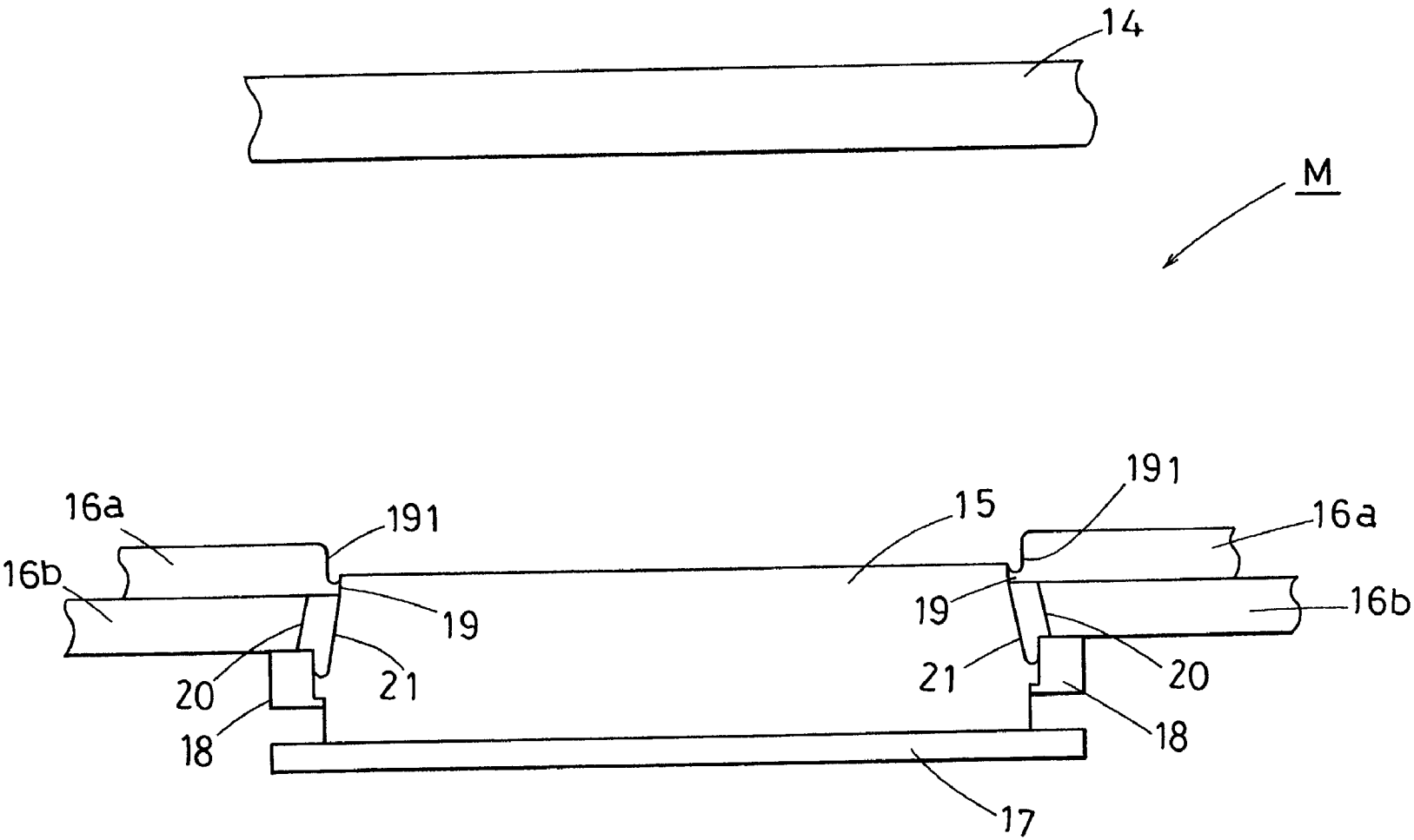
FIG. 5 is a front view of a forming machine for forming a curled potion at one open end of the green form of the cylindrical body.

The green cylindrical body 1*a* is then transferred to perform a curled portion forming step which may be carried out by a forming machine M shown in FIG. 5. The forming machine M performs a sequence of three steps, namely a first step of inwardly curling both edges 13*a* and 13*b* of the green cylindrical body 1*a*, a second step of increasing the cross-sectional area defined by of each curled portion by deforming each curled portion radially and outwardly, and a third step of pressing down the curled portions.

The forming machine M has a forming die 15, having substantially a circular shape in a plan view, placed on a platform 17 supported by a floor bed and fixedly held at an intermediate portion of its outer side with an annular chuck support 18. A first chuck 16*a* and a second chuck 16*b* which travel forward and backward along a horizontal direction are provided on an upper side of the chuck support 18. The first chuck 16*a* is located above the second chuck 16*b* and has a guide region 19 provided on an inner wall thereof for inwardly curling the edge of the roll with a guiding surface 191. The first chuck 16*a* is at an inner wall below the guide region 19 in direct contact with an outer side of the forming die 15. An inner wall of the second chuck 16*b*, which is located beneath the first chuck 16*a*, is a tapered surface 20 which is tilted to increase in opening towards a lower end of the second chuck 16*b* and is opposite to a tapered surface 21 of an outer side of the forming die 15 tilted at the same angle. A vertically movable pressing member 14 is provided precisely above the forming die 15 for pressing down the green cylindrical body against the forming die 15.

Figure 6:
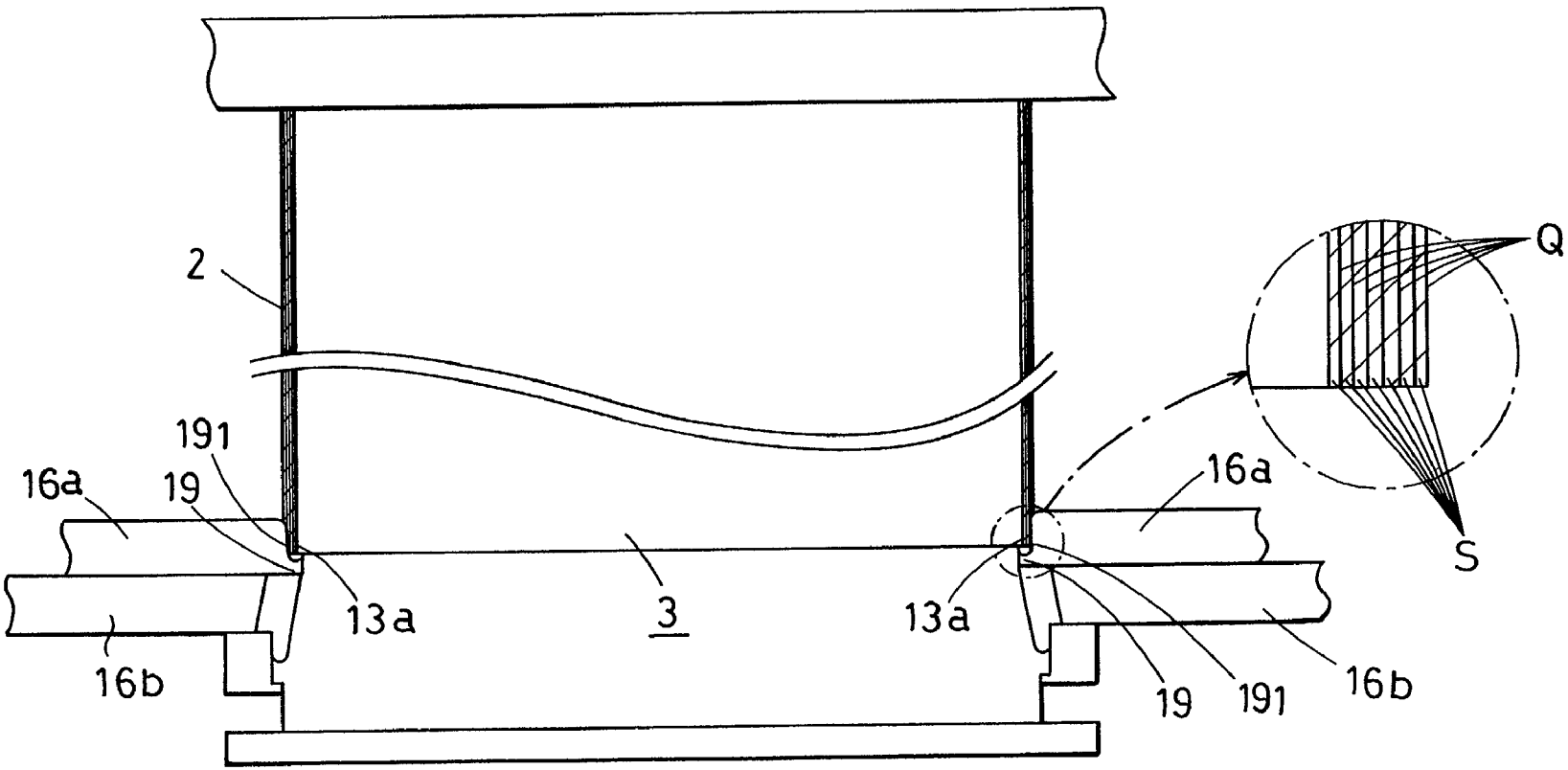
FIG. 6 is a cross sectional front view illustrating a step of forming the curled portion at the one open end of the green form which is placed on the forming machine.

In operation, the roll 2 of the layers of the paper sheet S before the adhesive Q is cured is loaded and placed upright on the guide region 19 of the first chuck 16*a* so that the edge 13*a* at the one opening 3 sits directly on the guide region 19, as shown in FIG. 6. While FIG. 6 illustrates the edge at the one opening 3 for simplicity of the description, the edge at the other opening 4 of the roll 2 can also be shaped after turning the roll 2 up side down.

Figure 7:
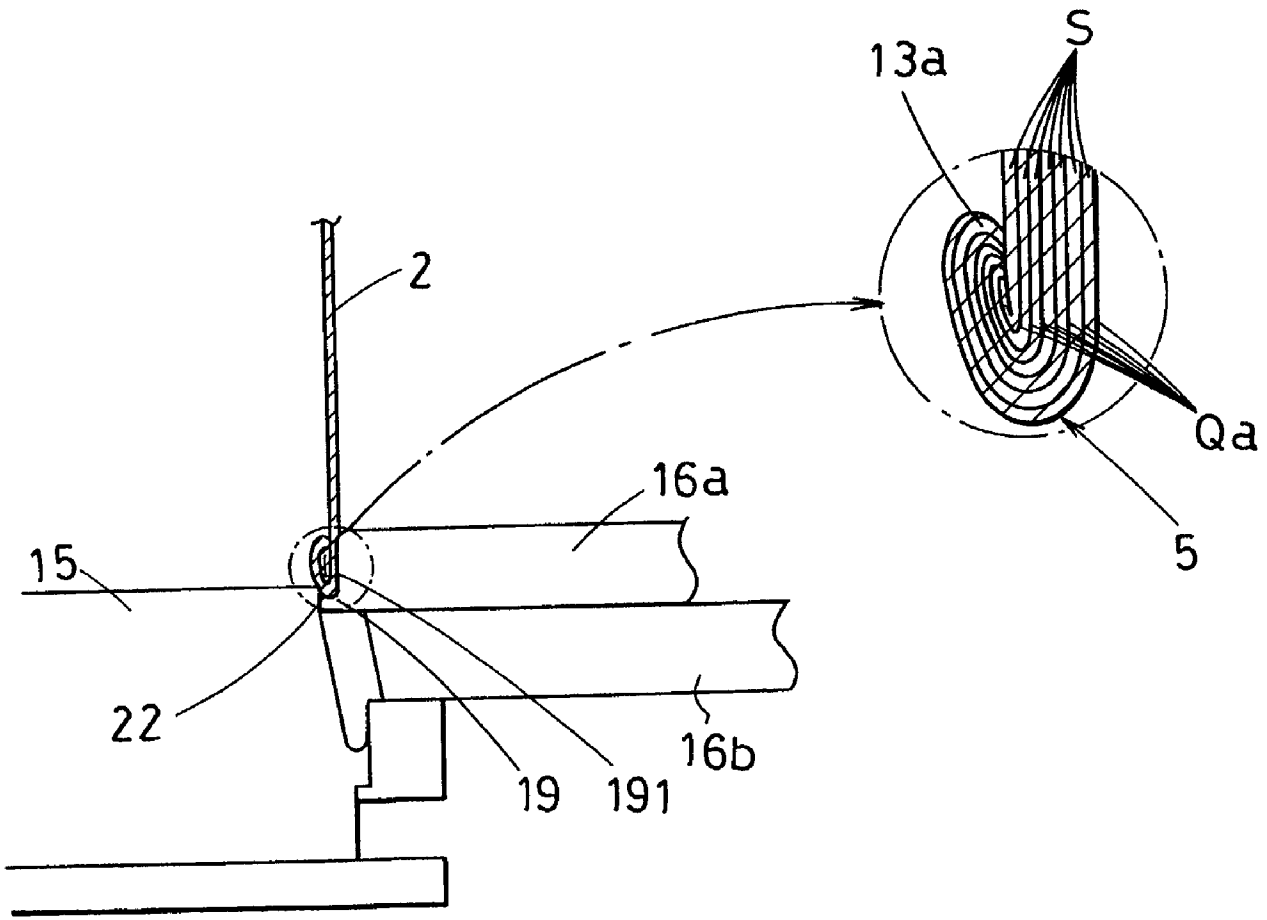
FIG. 7 is an enlarged cross sectional view illustrating the step of forming the curled portion at the one open end of the green form.

As the pressing member 14 is then lowered, the edge 13*a* of the roll 2 is pressed down between the guiding surface 191 of the guide region 19 and the outer side 22 of the forming die 15 to form an inwardly curled portion as shown in FIG. 7.

When pressed down, the inner layers of the paper sheet S of the green cylindrical body 1*a* lag behind the outer layers due to a difference in the curvature radius at the curled portion 5 or 6. The layers of the paper sheet S when curled are not separated but remain bonded to each other by the action of the adhesive Q. Also, the adhesive serves as a lubricant to assist the lagging. Simultaneously, as the layers of the paper sheet S are curled, portions of the adhesive Q between the layers of the edge 13*a* of the green cylindrical body 1*a* are squeezed out, hence running over the inner side of the roll 2. As a result, these portions of the adhesive Q may contribute to higher adhesiveness and when cured, the improved rigidity of the curled portions 5 and 6.

By the above manner, the curled portions 5 and 6 of the roll 2 are formed at the one opening 3 and the other opening 4, respectively. As known, the curled portions 5 and 6 are instantly formed in sequence. Then, as the adhesive Q is cured between the layers of the paper sheet into a cured adhesive Qa, the curled portions 5 and 6 are increased in rigidity.

Figure 8:
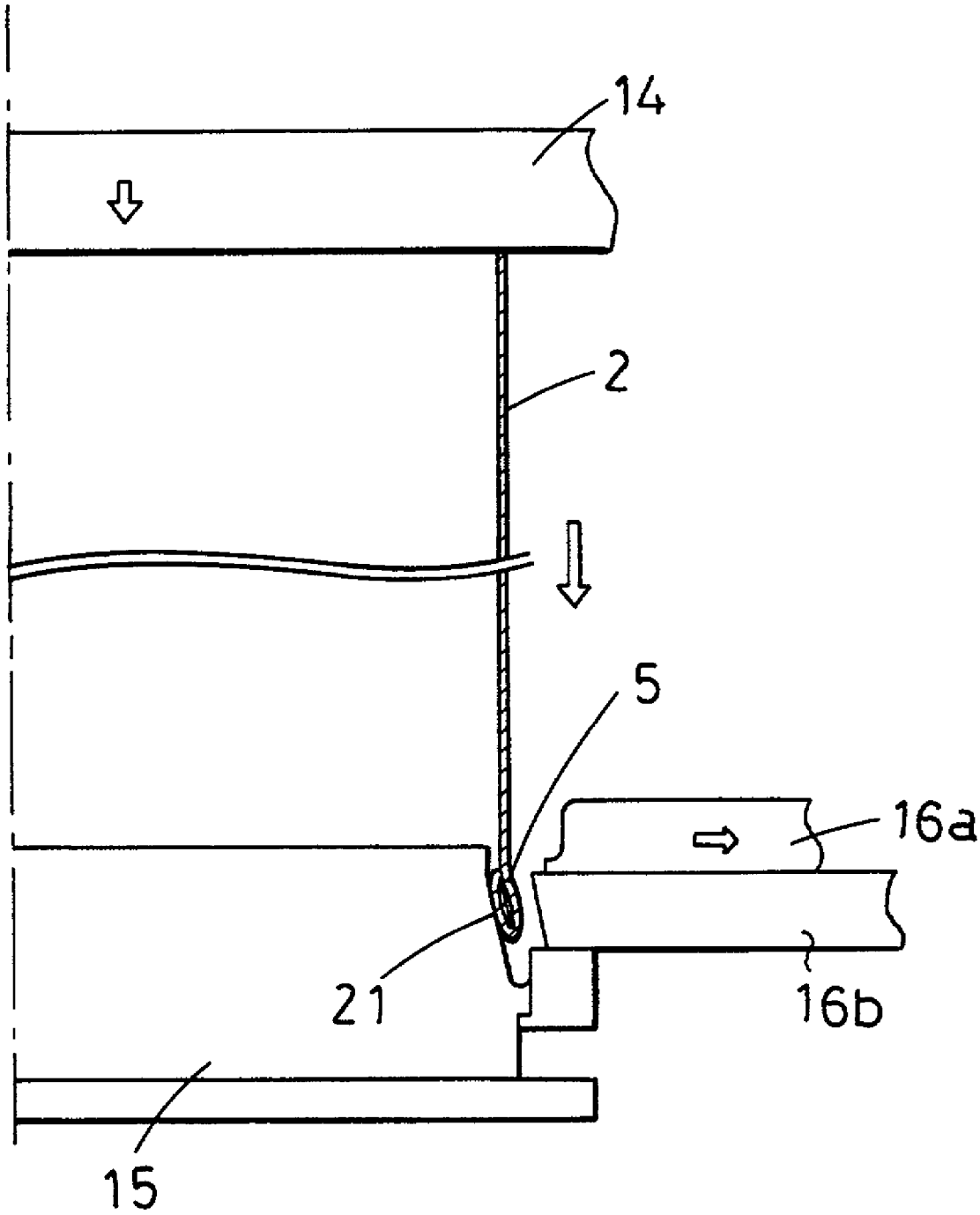
FIG. 8 is a cross sectional front view illustrating the step of forming the curled portion at the one open end of the green form where the curled portion is dislocated outwardly by the action of a forming die.

This is followed by retracting the first chuck 16*a* from the curled portions 5 and 6 and lowering the pressing member 14 further as shown in FIG. 8. As moved along the tapered surface 21 of the outer side of the forming die 15, the curled portion 5 is turned outwardly such that the curled portion forms an angle with an outer surface of the roll 2 that is between 0° and 180°. If the tilting angle is too large, the curled portion 5 may have flaws extending radially. When the tilting angle is too small, the effect of a tightening band or the like will be diminished. It is thus essential to determine an appropriate angle of tilting for ensuring the effect of the tightening band and eliminating the generation of flaws.

Figure 9:
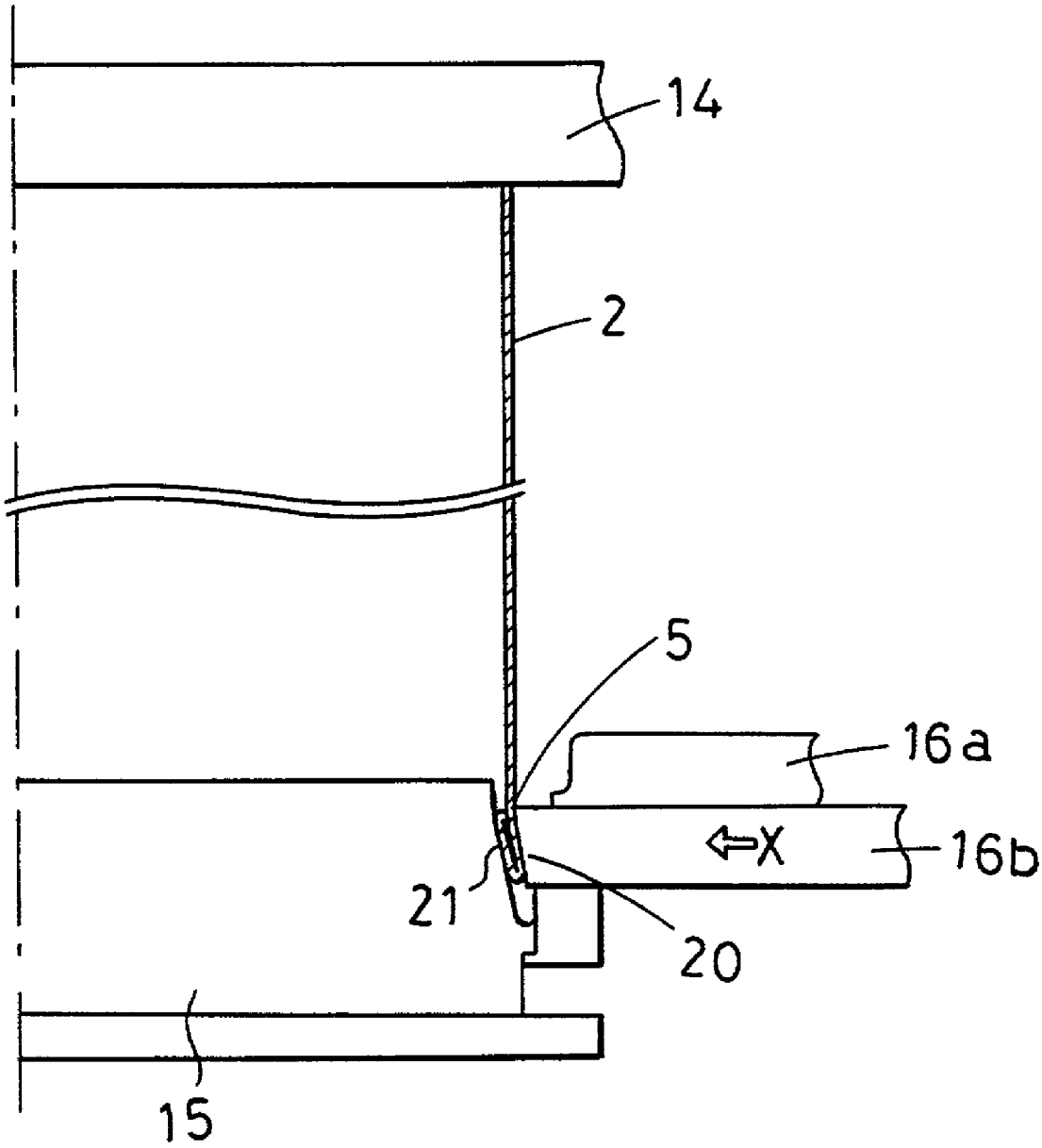
FIG. 9 is a cross sectional front view illustrating a step of forming the curled portion on the one open end of the green form where the dislocated curled portion is pressed with a chuck.

As shown in FIG. 9, the tilted curled portion 5 is held directly in contact with the tapered surface 21 of the forming die 15, and then the second chuck 16*b* is advanced in the direction X denoted by the arrow in FIG. 9 to press down the curled portion 5 so as to form a pressed curled portion that forms an angle with the outer surface of the roll 2 that is between 0° and 180°. Any hollow space in the curled portion 5 may decrease the physical strength at the opening of the roll 2. The pressing down of the curled portion 5 may require a pressing force of 30 tons. The cylindrical body 1*a* of this embodiment is rigid enough and its physical strength may be increased by pressing down the curled portions 5 and 6 to eliminate any hollow space.

As explained above, the three steps for forming, tilting, and pressing the curled portions 5 and 6 are carried out in the single forming machine M, which thus contributes to down sizing and a simpler arrangement of the fabricating system.

Figure 10:
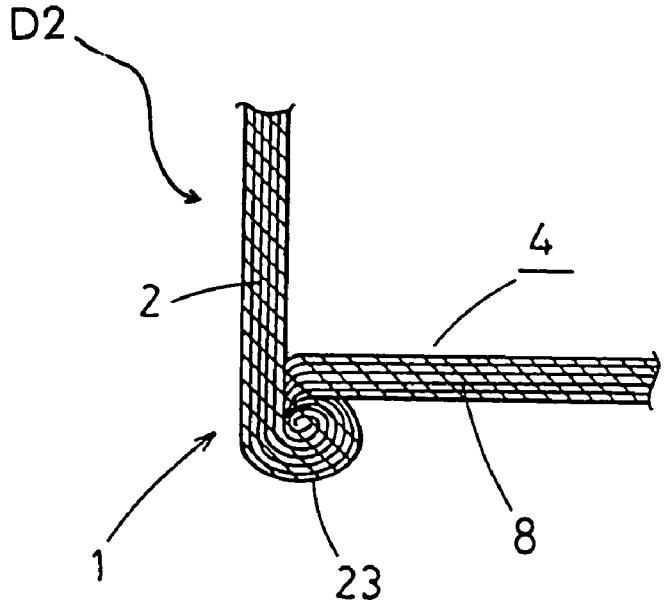
FIG. 10 is a cross sectional front view showing partially the bottom of a cylindrical body of a fiber drum according to another embodiment of the present invention.

The present invention is not limited to the curled portions 5 and 6 provided on the edges at the openings 3 and 4 of the roll 2, but may be implemented with a curled portion 23 formed by inwardly curling the edge at the bottom opening 4 of the roll 2 together with the edge of the disk bottom plate 8 made of the same paper material to thus constitute the cylindrical body 1 of a fiber drum D2 as shown in FIG. 10. Similar to the first embodiment, the curled portion 23 is also pressed to eliminate any hollow space. This embodiment is identical in the other arrangement to the first embodiment.

As the roll 2 and the bottom plate 8 are inwardly curled at their edges at one time, the method of fabricating the fiber drum D2 can significantly be simplified and thus is favorable for mass production by decreasing production costs. The curled portion 23 is pressed down and its physical strength will be increased to a desired level, thus eliminating the need of extra reinforcement members of a metal material. This requires no separation into paper material and metal material during disposal of the drum. Also, the cylindrical body 1 has no projection on an inner side thereof, and thus allows any powder in the drum to be readily removed without being trapped.

Figure 12:
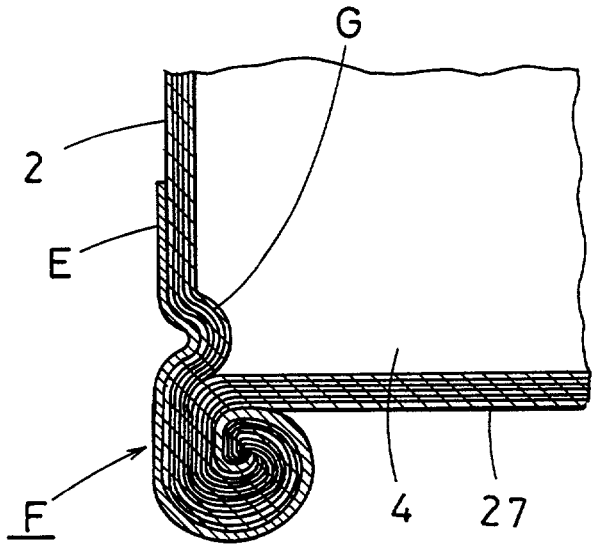
FIG. 12 is a cross sectional front view showing partially another modification of the bottom of the fiber drum.
Figure 13:
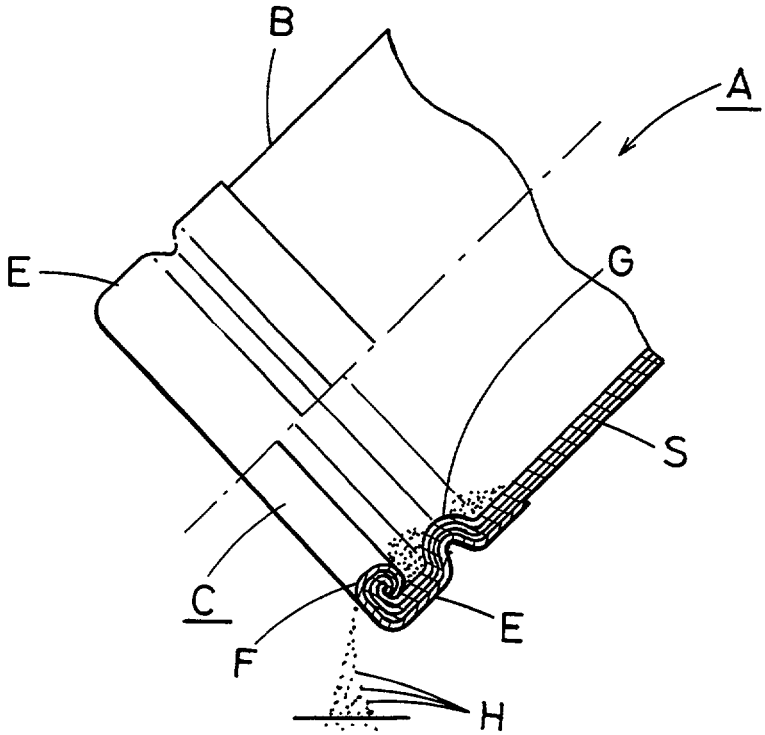
Prior Art Fig.13
FIG. 13 is an explanatory view showing a step of removing powder from one opening of a conventional fiber drum that is tilted.
Figure 14:
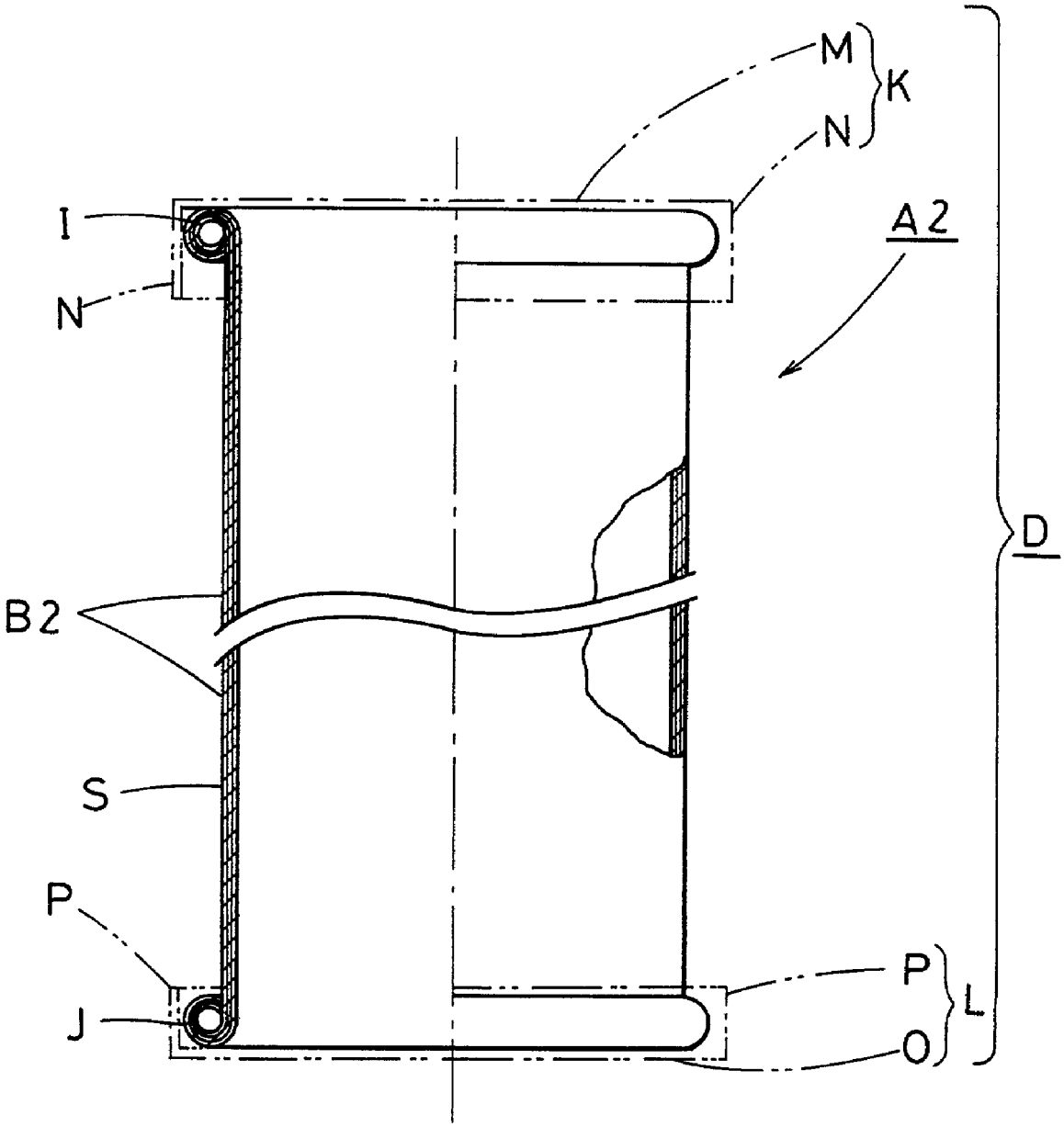
Prior Art Fig.14
FIG. 14 is a partially cross sectional front view of another conventional fiber drum.

Alternatively, the curled portion 5 at the opening 3 may be replaced by a curled portion F formed by inwardly curling the edge at the bottom opening 4 of a roll 2 together with a metal ring E and a bottom plate 27 of the same paper material as shown in FIG. 12. More particularly, the edge of the bottom plate 27 is sandwiched between the edge and an inward rib G of the roll 2.

In this embodiment, no metal is used at the upper opening 3 of the roll 2. Accordingly, the separation of a fiber drum into paper material and metal material is less troublesome than that of the conventional fiber drum having metal materials at both ends. This embodiment will contribute to reduction of industrial waste.

The cover plate 7 and the bottom plate 8 of each fiber drum are not limited to paper material but may be made of synthetic resin, metal, veneer plywood, or any other appropriate material.

It is also a good idea that when the adhesive Q is about cured before the curled portions 5 and 6 are completely shaped, the body is heated up for softening the adhesive Q between the layers of the paper sheets. If the adhesive Q is of a hot melting type, it has to be heated to higher than its melting point.

The invention claimed is:

1. A cylindrical body of a fiber drum, comprising:

a roll of paper having an axis, two open ends and an outer straight cylindrical circumferential surface, plural wound layers with a cured adhesive between said plural wound layers, and a pressed curled portion at at least one of said two open ends such that said pressed curled portion is more dense than said plural wound layers, said pressed curled portion having an outer circumferential surface, wherein said pressed curled portion is angled radially outwardly relative to said outer straight cylindrical circumferential surface of said roll of paper such that said outer straight cylindrical circumferential surface of said roll of paper forms an angle with said outer circumferential surface of said pressed curled portion that is greater than 0° and less than 180° and faces away from said axis of said roll of paper, and wherein said pressed curled portion is formed by inwardly curling a respective edge of said at least one of said two open ends while the adhesive between said plural wound layers is in a non-cured state.

2. The cylindrical body as recited in claim 1, wherein said curled portion includes an inner circumferential surface defining a line that is tangent thereto and parallel to said axis of said roll of paper, and wherein said roll of paper has an inner cylindrical surface defining a line that is parallel to said axis of said roll of paper, with a radial distance between the line that is tangent to said inner circumferential surface of said curled portion and the line defined by the inner cylindrical surface of said roll of paper being no greater than 1 mm.

3. The cylindrical body as recited in claim 2, wherein the line that is tangent to said inner circumferential surface of said curled portion is not radially further from said axis of said roll of paper than is the line defined by the inner cylindrical circumferential surface of said roll of paper.

4. The cylindrical body as recited in claim 1, wherein said pressed curled portion is defined by an end portion of said roll of paper which is curled upon itself such that a first portion of an inner surface of said roll of paper contacts a second portion of said inner surface of said roll of paper.

5. The cylindrical body as recited in claim 4, wherein said pressed curled portion is free of any support ring located between said first portion of said inner surface of said roll of paper and said second portion of said inner surface of said roll of paper.

6. The cylindrical body as recited in claim 1, wherein said pressed curled portion is free of any interior support ring.

7. A fiber drum comprising:

a roll of paper having an axis, two open ends and an outer straight cylindrical circumferential surface, plural wound layers with a cured adhesive between said plural wound layers, and a pressed curled portion at each of said two open ends such that each of said pressed curled portions is more dense than said plural wound layers, each of said pressed curled portions having an outer circumferential surface, wherein each of said pressed curled portions is angled radially outwardly relative to said outer straight cylindrical circumferential surface of said roll of paper such that said outer straight cylindrical circumferential surface of said roll of paper forms an angle with said outer circumferential surface of each of said pressed curled portions that is greater than 0° and less than 180° and faces away from said axis of said roll of paper, and wherein each of said pressed curled portions is formed by inwardly curling an edge of each of said two open ends while the adhesive between said plural wound layers is in a non-cured state;

a paper material cover plate detachably joined to said pressed curled portion at one of said two open ends such that the opening at said one of said two open ends is closed; and a paper material bottom plate fixedly joined to said pressed curled portion at the other of said two open ends such that the opening at said other of said two open ends is closed.

8. The cylindrical body as recited in claim 7, wherein each of said pressed curled portions includes an inner circumferential surface defining a line that is tangent thereto and parallel to said axis of said roll of paper, and wherein said roll of paper has an inner cylindrical surface defining a line that is parallel to said axis of said roll of paper, with a radial distance between the line that is tangent to said inner circumferential surface of a respective said curled portion and the line defined by the inner cylindrical surface of said roll of paper being no greater than 1 mm.

9. The cylindrical body as recited in claim 8, wherein the line that is tangent to said inner circumferential surface of a respective said curled portion is not radially further from said axis of said roll of paper than is the line defined by the inner cylindrical circumferential surface of said roll of paper.

10. The fiber drum as recited in claim 7, wherein each of said pressed curled portions is defined by a corresponding end portion of said roll of paper which is curled upon itself such that a corresponding first portion of an inner surface of said roll of paper contacts a corresponding second portion of said inner surface of said roll of paper.

11. The fiber drum as recited in claim 10, wherein each of said pressed curled portions is free of any support ring located between said corresponding first portion of said inner surface of said roll of paper and said corresponding second portion of said inner surface of said roll of paper.

12. The fiber drum as recited in claim 7, wherein each of said pressed curled portions is free of any interior support ring.

13. A fiber drum comprising:

a roll of paper having an axis, two open ends and an outer straight cylindrical circumferential surface, plural wound layers with a cured adhesive between said plural wound layers, and a pressed curled portion at each of said two open ends such that each of said pressed curled portions is more dense than said plural wound layers, each of said pressed curled portions having an outer circumferential surface, wherein said pressed curled portion at one of said two open ends is angled radially outwardly relative to said outer straight cylindrical circumferential surface of said roll of paper such that said outer straight cylindrical circumferential surface of said roll of paper forms an angle with said outer circumferential surface of said pressed curled portion at said one of said two open ends that is greater than 0° and less than 180° and faces away from said axis of said roll of paper, and wherein each of said pressed curled portions is formed by inwardly curling an edge of each of said two open ends while the adhesive between said plural wound layers is in a non-cured state;

a paper material cover plate detachably joined to said pressed curled portion at said one of said two open ends such that the opening at said one of said two open ends is closed; and a paper material bottom plate fixedly joined to said pressed curled portion at the other of said two open ends such that the opening at said other of said two open ends is closed, wherein said pressed curled portion at said other of said two open ends is formed by inwardly curling said edge of said other of said two open ends together with a circumferential edge of said paper material bottom plate, while the adhesive between said plural wound layers is in a non-cured state, to fixedly join said edge of said other of said two open ends to said paper material bottom plate.

14. The cylindrical body as recited in claim 13, wherein said curled portion at said one of said two open ends includes an inner circumferential surface defining a line that is tangent thereto and parallel to said axis of said roll of paper, and wherein said roll of paper has an inner cylindrical surface defining a line that is parallel to said axis of said roll of paper, with a radial distance between the line that is tangent to said inner circumferential surface of said curled portion at said one of said two open ends and the line defined by the inner cylindrical surface of said roll of paper being no greater than 1 mm.

15. The cylindrical body as recited in claim 14, wherein the line that is tangent to said inner circumferential surface of said curled portion at said one of said two open ends is not radially further from said axis of said roll of paper than is the line defined by the inner cylindrical circumferential surface of said roll of paper.

16. The fiber drum as recited in claim 13, wherein said pressed curled portion at said one of said two open ends is defined by an end portion of said roll of paper which is curled upon itself such that a first portion of an inner surface of said roll of paper contacts a second portion of said inner surface of said roll of paper.

17. The fiber drum as recited in claim 16, wherein said pressed curled portion at said one of said two open ends is free of any support ring located between said first portion of said inner surface of said roll of paper and said second portion of said inner surface of said roll of paper.

18. The fiber drum as recited in claim 13, wherein said pressed curled portion at said one of said two open ends is free of any interior support ring.

* * * * *